US005673057A

United States Patent [19]

Toland et al.

[11] Patent Number: 5,673,057

[45] Date of Patent: Sep. 30, 1997

[54] THREE AXIS BEAM WAVEGUIDE ANTENNA

[75] Inventors: Brent T. Toland, Manhattan Beach; William M. Hughes, Torrance; Dan R. Johnson, Los Angeles, all of Calif.

[73] Assignee: TRW Inc., Redondo Beach, Calif.

[21] Appl. No.: 556,321

[22] Filed: Nov. 8, 1995

[51] Int. Cl.[6] ..... H01Q 19/19

[52] U.S. Cl. ..... 343/761; 343/781 GA

[58] Field of Search ..... 343/761, 781 CA, 343/781 P, 779, 757, 758, 763, 765, 766, 839; H01Q 19/19

[56] References Cited

U.S. PATENT DOCUMENTS

| | | | |
|---|---|---|---|
| 3,845,483 | 10/1974 | Soma et al. | 343/761 |
| 4,044,361 | 8/1977 | Yokoi et al. | 343/754 |
| 4,375,878 | 3/1983 | Harvey et al. | 74/5.1 |
| 4,516,128 | 5/1985 | Wantanabe et al. | 343/761 |
| 4,525,719 | 6/1985 | Sato et al. | 343/761 |
| 4,559,540 | 12/1985 | Betsudan et al. | 343/761 |
| 4,821,045 | 4/1989 | Capdepuy et al. | 343/781 |
| 4,833,932 | 5/1989 | Rogers | 244/158 |
| 5,091,733 | 2/1992 | Labruyere | 343/882 |
| 5,374,939 | 12/1994 | Pullen | 343/839 |

OTHER PUBLICATIONS

B. Claydon, "Beam Waveguide Feed for a Satellite Earth Station Antenna", *The Marconi Review*, vol. 34 #201 pp. 81–116.

K.K. Chan et al, "Some Aspects of Beam Waveguide Design", *IEEE Proc.* vol. 129 Pt.H. No. 4 Aug. 1982 pp. 203–210.

*Primary Examiner*—Hoanganh T. Le

*Attorney, Agent, or Firm*—Michael S. Yatsko; Ronald M. Goldman

[57] ABSTRACT

A beam waveguide type dual reflector (3, 4) type antenna, referred to as a Cassegrain antenna, is constructed with a beam waveguide (5, 6, 9, 11, 13, 15), having three axes of rotation (X1, Y1, & Z1), the first (X1) and second axes (Y1) of rotation being perpendicular to each other and the second (Y1) and third (Z1) axes of rotation being perpendicular to each other and with the spacing between the first (X1) and third (Z1) axes being constant to achieve a greater field of view, while retaining the capability of handling simultaneously cross polarized microwave signals. Actuator singularities, defining forbidden regions, singularity associated with rotation about the first and second axes are avoided by switching to rotation about the first and third axes as the singularity is approached by the antenna, permitting the antenna to move through that singularity region.

18 Claims, 3 Drawing Sheets

THREE AXIS BEAM WAVEGUIDE ANTENNA

FIELD OF THE INVENTION

This invention relates to dual reflector antennas, such as the Cassegrain, of the beam waveguide type and, more particularly, to an improved beam waveguide therefor that permits varying the antenna position over a greater spherical range than previously possible to afford a greater field of view.

BACKGROUND

A predominant type of large size antenna used for earth stations in a satellite microwave communication system and in radar application is the Cassegrain antenna, a dual reflector arrangement containing a main reflector and a subreflector. Such Cassegrain antennas are rotatably mounted so that by appropriate changes in the antenna's elevation and azimuth the antenna may be pointed skyward and properly focused upon a selected satellite. To avoid the problems associated with the antenna carrying and moving along the associated electronic equipment, such as the microwave transmitters and receivers, during repositioning of the antenna, antenna systems of that type typically include a beam wave guide feed system. That feed system permits the microwave transmitters and receivers and the associated feed horn to remain stationary in position, while the antenna is varied in position about two mutually orthogonal axes. This effectively mechanically decouples the microwave equipment from the antenna, freeing the actuator mechanisms of that extra weight and inertia and permitting the antenna to be rotated in azimuth and elevation independently of the transmitter and receiver equipment.

The beam waveguide comprises a series of electromagnetic energy reflecting surfaces, referred to as mirrors, typically formed of electrically conductive material, to define a path for propagating that energy to or from the systems microwave feed horn to the Cassegrain antenna. As example, electromagnetic energy from the feed horn is reflected from one mirror to another along the defined path and to the last mirror, which is mechanically coupled to and rotates with the antenna. That last mirror focuses the electromagnetic energy through the passage in the rear of the antenna's main reflector onto the subreflector.

Typically, a beam wave guide employs four such mirrors. Two of those mirrors are flat and, typically, are elliptical in geometry and two are curved, parabolic, in geometry. However, as known from the literature, many variations in curvature, placement and number are possible.

Moreover, some of those mirrors are rotatable with the antenna about mutually perpendicular axes, serving thus as parts of a rotatable microwave joint in the microwave transmission path between the microwave equipment and the antenna, whereby the antenna's azimuth and elevation may be changed, without changing the length of the transmission path and only changing the angular direction of portions of the transmission path.

The foregoing antenna system structure is well known and many examples of those beam waveguide antenna systems appear in the patent literature to which the interested reader may make reference, such as "Some aspects of beam waveguide design", K. K. Chan et al, *IEEE Proc.* Vol. 129, Pt. H. No. 4, August 1982 pp203–201; "Beam Waveguide Feed for a Satellite Earth Station Antenna", B. Claydon, *The Marconi Review,* Vol. 34 No. 201, 1976, pp81–116; Sato et al U.S. Pat. No. 4,525,719 Jun. 25, 1985; Watanabe et al. U.S. Pat. No. 4,516,128 Mar. 7, 1985; and Betsudan et al. U.S. Pat. No. 4,559,540 Dec. 17, 1985.

All antennas, including the Cassegrain, are inherently bidirectional or, as variously termed, reciprocal in nature. The antenna both radiates electromagnetic energy inputted by a RF transmitter and receives electromagnetic energy for coupling to an RF receiver. The Cassegrain antenna is particularly used for simultaneously transmitting and receiving circularly polarized microwave energy, specifically both right hand circularly polarized waves and left hand circularly polarized waves. Those circularly polarized waves may be individually generated and/or detected. Hence both types, even though of the same frequency, may be simultaneously handled by a single antenna, a form of multiplexing that makes more efficient use of the available frequency spectrum.

Such multiplexing capability may be lost or rendered ineffectual should the microwave transmission circuit associated with coupling the transmitter and/or receiver to the antenna introduce sufficient "depolarization" of the electromagnetic waves. To avoid depolarization in such antennas, changes to that transmission circuit can be made but only with extreme engineering caution. It is known that the present four mirror dual axis waveguide beam associated with present land based positionable Cassegrain antennas introduces only minimal depolarization of the electromagnetic waves, a factor in the success of that design.

The exploding technological growth in satellite communications generates, among other things, a need for satellite to satellite tracking and communication, whereby one satellite may transmit microwave energy, modulated with data or audio information, to another satellite, a link, and the latter satellite may in turn transmit that data or information to a ground station situated within the latter satellite's communication range. For that purpose, the one satellite must be able to track and maintain a communication antenna directed at the other satellite, and that requires frequent re-positioning of the antenna's direction.

Despite being positionable to many angular positions within a hemisphere, the dual axis beam waveguide Cassegrain antenna is restricted in its field of view. These limits imposed by the associated electrical positioning actuators are referred to as actuator "singularities". Singularities occur when the main reflector centerline direction, the reflector's elevation, in present ground systems terminology, approaches the azimuthal axis direction. In other words, in respect of a ground based station, the antenna approaches pointing directly overhead, straight up.

The electrical position actuators, which position the antenna, increase in rotational speed to maintain a given beam tracking rate, the rotational speed tending to increase toward infinity as the main reflector approaches this singularity. High speed imposes undue stresses on the actuators and control system, resulting in increased weight, power, and design complexity, and risking loss of pointing control as the disturbances inherent in any gimbal system are amplified. As is known, all prior beam waveguide type dual reflector antennas produce one or more such singularities in the forward hemisphere. The designer's answer is to avoid those singularities by restricting the antenna's field of view, limiting that view to regions outside of the singularities. Effectively, this produces a blind spot in the antenna's field of view.

In ground stations the existence of singularities is relatively transparent since in practice satellite orbits are rarely overhead and usually follow an orbit where the satellite appears at some reasonable elevation above the horizon. Where an expected path would otherwise fall into a singularity, the ground antenna system construction is modified to ensure that the singularity falls outside the desired field of view.

Although such dual axis beam waveguide Cassegrain antennas are effective for ground station application, the singularities inherent in operation of those antennas prove a severe obstacle to effective application of a smaller size copy of that antenna in space borne satellites. The satellite links often require a much greater field of view for the antenna than for land based systems. It is not possible to relocate all singularities in the present antenna system outside the field of view desired for a satellite link. To avoid degraded link performance it is necessary to eliminate singularities from the field of view. Additionally, relative motion between satellites occurs much more rapidly than motion of a satellite relative to a ground location. Hence, a satellite antenna in a satellite to satellite link, must be repositioned much more quickly than the land based antenna.

Alternatives are necessarily considered to avoid such singularities. As example, one might reorient the satellite and hence the antenna carried thereby through ground station control. However, most satellites contain more than one antenna, pointing at other specific widely spaced locations on earth or to other satellites. By reorienting one link antenna to avoid a singularity, the other antennas would also require repositioning. That would be possible only if those antennas are also repositionable and only if their repositioning would not similarly place those other antennas within a forbidden singularity.

Accordingly, an object of the present invention is to provide a greater field of view for a dual reflector antenna of the beam waveguide type;

Another object of the invention is to provide a new antenna structure suitable for space borne satellite to satellite communication links; and An ancillary object of the invention is to produce a more flexible beam waveguide for a positionable Cassegrain antenna that allows the antenna to be positioned over a greater field of view without introducing unacceptable depolarization of circularly polarized electromagnetic waves transmitted and/or received by the antenna.

SUMMARY OF THE INVENTION

In accordance with the foregoing objects, the present invention provides a dual reflector type antenna, such as a Cassegrain antenna, that is of the beam waveguide type, with three axes of rotation, the first and second axes of rotation being perpendicular to each other and the second and third axes of rotation being perpendicular to each other and with the spacing between the first and third axes being constant. The novel antenna may be oriented over a portion of a sphere that is greater than permitted in the prior wave guide beam type dual reflector antennas. By rotating the antenna about only the first and second axes various angular positions are attained. However as the antenna approaches a singularity in position the rotation about the first and second axes is discontinued and the antenna is thereafter rotated about the first and third axes. This allows the antenna to proceed through the singularity associated with the first and second axes to the desired angular position. Effectively, the improved antenna system removes the singularity associated with dual axes, thereby increasing the available field of view in comparison to the prior land based antennas of this type.

One specific embodiment of the invention is characterized by at least one and, preferably, two additional flat mirrors positioned intermediate the feed horn and a mirror associated with the input to a four mirror system of the type associated with the prior beam waveguide system to permit coupling of electromagnetic energy between the feed horn and the latter mirror. Another rotatable mount supports the foregoing structure for rotational positioning about a third axis, perpendicular to the second axis and one of the additional flat mirror is mounted for joint rotation therewith to permit coupling of electromagnetic energy between the feed horn and the beam waveguide irrespective of the degree of rotation of the additional rotational mount.

The foregoing and additional objects and advantages of the invention together with the structure characteristic thereof, which was only briefly summarized in the foregoing passages, becomes more apparent to those skilled in the art upon reading the detailed description of a preferred embodiment, which follows in this specification, taken together with the illustration thereof presented in the accompanying drawings.

DESCRIPTION OF THE PREFERRED EMBODIMENTS

Figure 1:
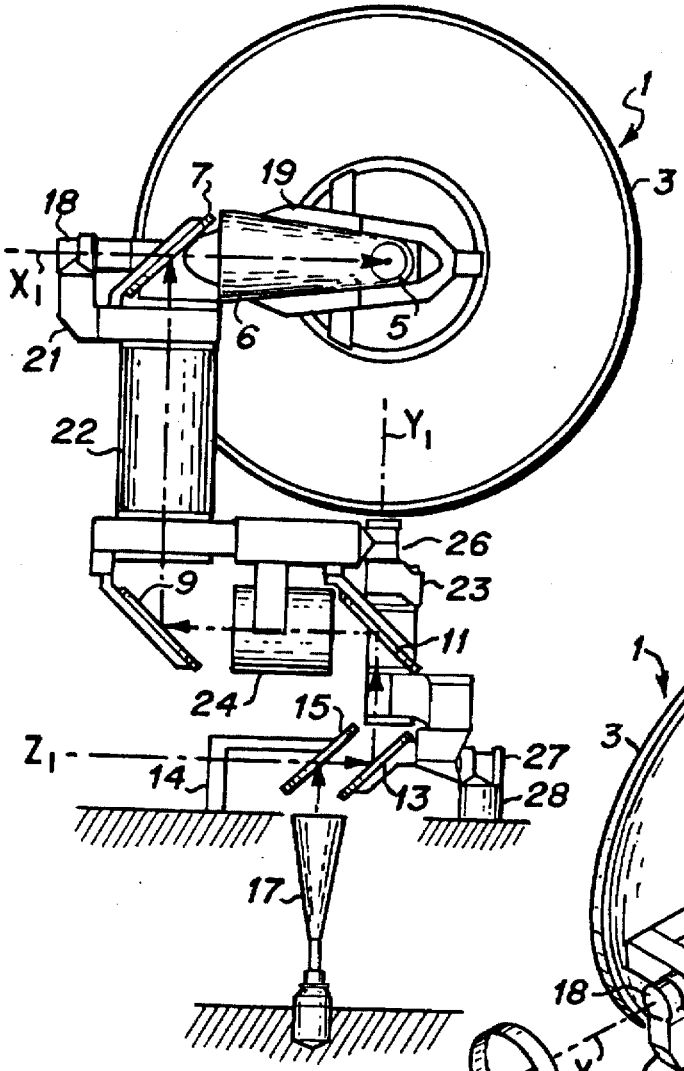
FIG. 1 illustrates an embodiment of the invention in a partial side view.
Figure 2:
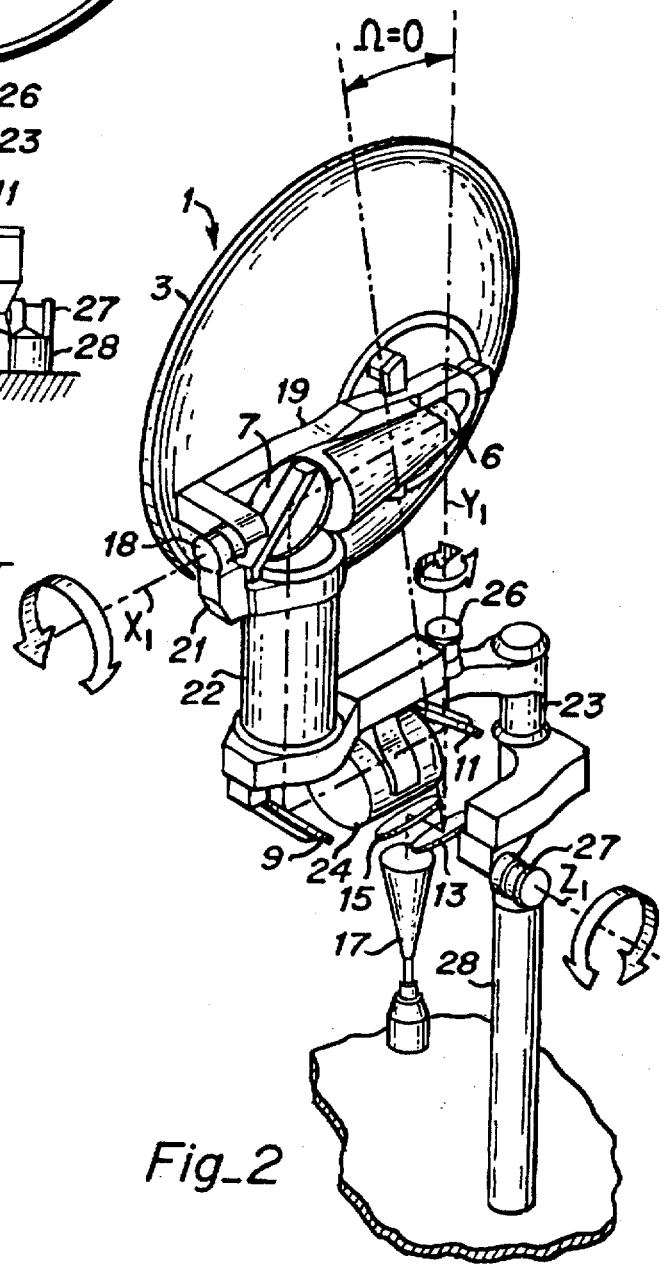
FIG. 2 is another view of the embodiment of FIG. 1 in partial isometric view.
Figure 4:
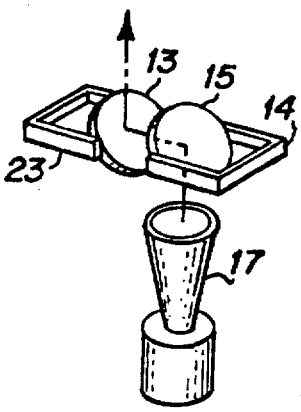
FIG. 4 is a pictorial illustration of supports for two mirrors used in the embodiment of FIG. 1.

Reference is made to FIG. 1, which partially illustrates a rear view of an embodiment of the invention, and to FIG. 2, which partially illustrates the embodiment of FIG. 1 in a isometric pictorial view, which are considered together. The figures present a Cassegrain antenna 1, containing a main reflector 3 and a subreflector 4, not visible in these two views, but illustrated in FIG. 4, and a series of microwave RF reflecting surfaces, suitably an electrically conductive metal that reflects microwave energy, and, hence, are referred to as mirrors. These mirrors include a planar mirror 5, located adjacent the central passage in main reflector 3, a parabolic mirror 7, a second flat mirror 9, and a second parabolic mirror 11; a fourth planar mirror 13 and a fifth planar mirror 15. It is noted that the curvature of parabolic mirrors 7 and 11 is so slight that they appear to be flat in appearance in the figures. A microwave RF transmission apparatus containing a feed horn 17 is located in a stationary position underlying mirror 15.

A bracket 19 attaches to main reflector 3 and supports flat mirror 5 in fixed position relative to that reflector and supports a metal cone section 6, shown in section in FIG. 1. The metal cone surrounds a portion of the path between mirrors 5 and 7 and provides structural support. Bracket 19 is, in turn, rotatably supported by another bracket 21.

As illustrated, bracket 21 is formed of many parts, not separately numbered, into the unitary L-shaped structure illustrated. The bracket supports parabolic mirror 7, flat mirror 9 and parabolic mirror 11 in fixed spacial position relative to one another and to mirror 5. As is customary, bracket 21 includes a tubular metal section 22 in between mirrors 7 and 9 and another tubular metal section 24 in between mirrors 9 and 11. The metal cylinders provide structural mechanical support in the assembly.

An electrical actuator 18 is situated on one of the brackets 19 and 21 and its rotary output is coupled to the other. The actuator is coupled to an electrical controller by flexible electrical leads or cables, neither of which is illustrated in the figures. The actuator rotatably positions the bracket 19, antenna 1 and mirror 5 about the axis of rotation of the rotary joint, which axis is referred to herein as the outboard axis, $X_1$.

Bracket 21 is rotatably supported in turn by a third bracket 23, which thereby supports all the elements supported by bracket 21. A second electrical actuator 26 is situated on one of the brackets 21 and 23 and its rotary output is coupled to the other. Actuator 26 rotatably positions bracket 21, hence positions the assembly of the four mirrors and antenna, about the axis of rotation of the rotary joint, referred to herein as the midboard axis, $Y_1$. The midboard axis is oriented by bracket 21 in fixed position perpendicular to the outboard axis, earlier described.

As those familiar with the dual axis beam type dual reflector antennas recognize, excepting for certain aspects of bracket 23, the structure described to this point resembles the existing land based dual axis beam waveguides in which the four mirrors are rotated as a unitary assembly about an azimuthal axis and the one mirror at the main reflector, though retaining in the same spacial relationship to the other mirrors, is rotated with the antenna about an elevation axis.

Bracket 23 contains a number of portions, including an upper portion and an intermediate tubular portion, which are adjustable in relative rotational position and a lower portion which attaches to and supports flat mirror 13. The rotational position of the upper portion is adjusted so that the midboard axis $Y_1$, mirror 11 is centered over mirror 13. Following the adjustment, the two arms are fixed, by means of a set screw, not illustrated, or other device to maintain that relationship. As is conventional practice, the other mirrors are aligned as shown. Bracket 23 is rotatably supported in turn by a support tube 28, illustrated in FIG. 2, which thereby supports all the elements supported by bracket 23. Support tube 28 is stationary in position, being anchored to a location on the space ship which serves as the base to the antenna.

A third electrical actuator 27 is situated on one of the brackets 23 and 28 and its rotary output is coupled to the other. Actuator 27 rotatably positions bracket 23, hence positions the assembly of the four mirrors 5, 7, 9 and 11 and antenna 1, about the axis of rotation of the rotary joint, referred to herein as the inboard axis, $Z_1$. This actuator also rotates mirror 13, which is centered on the inboard axis, about the inboard axis. The inboard axis is oriented by bracket 23 in fixed position perpendicular to the midboard axis, earlier described.

A bracket 14, illustrated only in FIG. 1, supports mirror 15 in a stationary in position, along with the feed horn 17, relative to mirror 13 to reflect microwave energy between the two. Bracket 14 is anchored to a stationary location or base on the spacecraft as represented by the anchor symbol in the figure. Thus each of inboard actuator 27, support tube 28 which supports that actuator, mirror 15 and feed horn 17 are stationary in position. Suitably the mirror and feed horn may be affixed to different positions of such base, which, as this antenna system is intended for space craft use, may conveniently be a wall or part of the frame structure of the space craft, the details of which are not necessary to an understanding of the invention and are therefor not illustrated.

Figure 3:
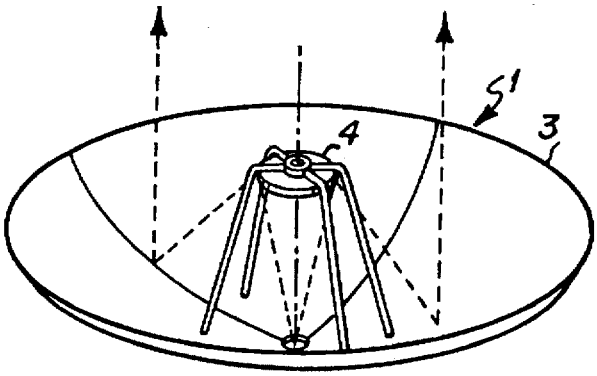
FIG. 3 is a front view of the antenna used in the embodiment of FIG. 1.

Reference is made to the pictorial top perspective view of the Cassegrain antenna presented in FIG. 3. As shown the subreflector 4 is a convex surface positioned by various supports at the focal point of the concavely shaped main reflector 3. Microwave energy reflected from mirror 5, illustrated in FIG. 1, located on the other side of the main reflector in this view, is focused through the central passage through the main reflector and is incident upon subreflector 4. That energy is reflected and dispersed therefrom to the concavely curved walls of main reflector 3, which, in accordance with known physical principals, reflects that energy in straight parallel lines. When receiving microwave energy, the received microwave energy follows the reverse or reciprocal path and is focused through the central opening to mirror 5.

Bracket 14 is of a U-shape and grips mirror 15 from the two sides so as not to interfere with the microwave transmission path. This is illustrated pictorially in FIG. 4. Flat mirrors 13 and 15 are formed to a flatness of 1 mil or better and like all the mirrors in the system are preferably formed of a graphite composition on which aluminum or gold is deposited in a vapor deposition to form the reflective electrically conductive mirror surface. Each of the two mirrors is suitably elliptical in shape. However, when viewed along the axis of the transmission path the ellipse appears as a circle.

Figure 5:
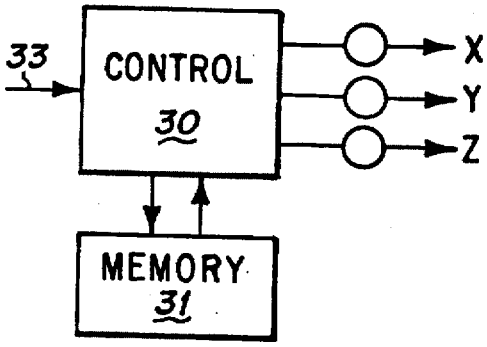
FIG. 5 is a block diagram of the control for the antenna.

In operation, the three actuators are electrically connected to a controller 30, such as is generally illustrated in FIG. 5, which typically includes a programmed digital computer and an associated memory 31. The computer receives appropriate input instructions, represented as 33, for positioning the antenna. At its outputs X, Y, and Z, the computer supplies the electrical current necessary to energize each of the actuators, via electrical leads, not illustrated, to point the antenna to the desired spherical coordinate, typically focusing the antenna on another satellite in the link. As the relative position of the remote satellite changes, the computer provides the electrical current to the actuators to correctly reorient the antenna, maintaining it focused on the remote satellite. The controller also includes additional inputs, not illustrated, for receiving position information from position sensors, such as those hereafter briefly described.

Positioning actuators 18, 26 and 27 are of conventional structure. As is conventional for these type of electrical actuators, the actuators rotate the one part of the structure relative to the other in response to electrical energy supplied from the controller and maintain the part in that new position. Each such actuator customarily includes a servo, not illustrated which serves as a position sensor to provide positive information on rotational position to the controller.

Figure 6:
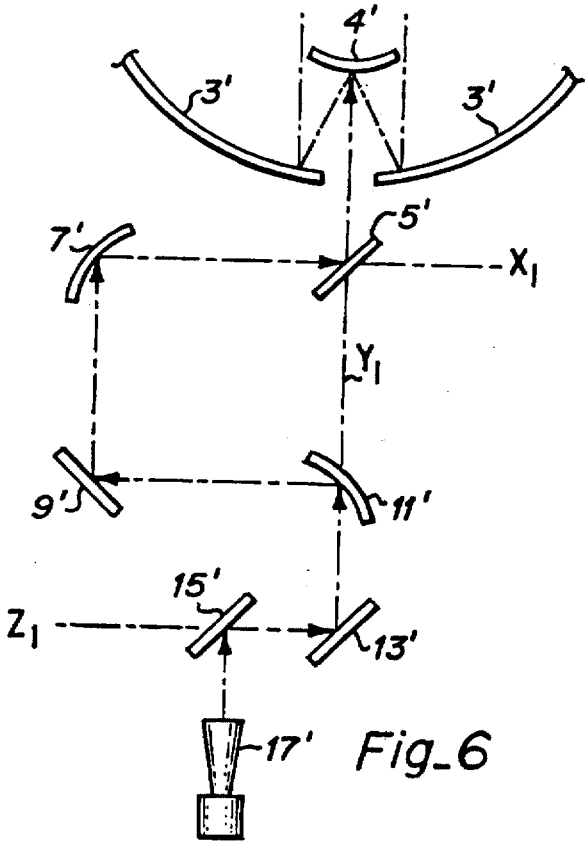
FIG. 6 is a simplified pictorial illustration of the microwave transmission path in the antenna of FIG. 1.

Reference is made to the simplified pictorial illustration of FIG. 6 which provides a simple illustration of the microwave transmission path through the novel beam waveguide. For convenience the elements are given the same numerical designation used in the prior figures. The mirrors 11', 9', 7' and 5' define a path to the central passage in main reflector 1 for the microwave energy, in which mirror 11' serves as the path entrance and mirror 5' serves as the path exit. Microwave energy incident on parabolic mirror 11' is reflected to flat mirror 7' and is reflected thereby to parabolic mirror 7' and reflected again to planar mirror 5, which reflects that energy through the central passage in the main reflector 3' to the subreflector 4'.

In prior systems feed horn 17' provided its spherical wave transmission directly to parabolic mirror 11', which converts the spherical wave to a parallel wave. That parallel wave is reflected off mirror 9' to curved parabolic mirror 7'. As that parallel wave is reflected off mirror 7' it again expands to a spherical wave which reflects off mirror 5' and enters the antenna where it is reflected off the subreflector to the main reflector 3' and thereupon radiated as a more narrow beam. With the present invention, the microwave transmission from feed horn 17' is reflected from mirror 15' to mirror 13'. From mirror 13' the microwave energy is reflected to mirror 11'. From mirror 11' the microwave energy propagates as previously discussed.

In effect, the present invention adds another microwave transmission path and an additional microwave rotary joint. It may be noted that in alternative embodiments, feed horn 17' may be placed along the $Z_1$ illustrated so as to have a straight transmission path to mirror 13', in which embodiment mirror 15' may thus be omitted. However, such is more complicated mechanically and the illustrated arrangement is preferred.

Outboard axis $X_1$ is oriented by the structure perpendicular to the axis of rotation of midboard axis $Y_1$ and midboard axis $Y_1$ is oriented perpendicular to inboard axis $Z_1$. Axis $Z_1$ is also spaced by a fixed distance from axis $X_1$ and the latter two axes lie in parallel planes, a constant, as formed by the support bracket structure. And the three axes do not intersect. In the initial position presented in FIG. 2, axis $Z_1$ is also shown oriented perpendicular to axis $X_1$, wherein the three axes are positioned mutually perpendicular, orthogonal, to one another. However, as is apparent, should some rotation of bracket 21 occur about axes midboard axis $Y_1$ and inboard $Z_1$ during operation, outboard axis $X_1$ will no longer be oriented perpendicular to axis $Z_1$. Axis $X_1$ could theoretically be moved to a position in which axis $X_1$ is in a common plane with and is oriented parallel to axis $Z_1$, as, for example, is illustrated in FIGS. 2 and 6. However, the distance spacing the latter two axes remains constant.

Reference is again made to the controller of FIG. 5. Although computer programs for dual axis beam waveguide antenna systems are well known, minor modifications to those programs are required to account for the additional axis of rotation and associated positioning motors or actuators. Complete data on the hemispherical positions of singularities on two pairs of rotational axes, x and y and y and z, are required instead of just the one pair, x and y associated with the prior ground station based antenna. And a check and switch subroutine is included, so that the antenna positioning control may switch from the one pair of rotational axes, should a singularity be approached, to a second pair of rotational axes. As desired like singularities found between axes X and Z may also be compiled and stored in the controller's memory.

As example, assuming the system is operating within mode 1 as prescribed by the computer, a branch subroutine in the program checks whether the antenna is moving to a singularity by checking the positional information that is used to energize the gimbal antenna positioning motors and comparing that to the singularity positions that were precalibrated and maintained in memory. If the check shows negative, the subroutine returns to the main program. However, if the test proves affirmative, then the subroutine returns a command to the computer to switch from mode 1 to mode 2. As those skilled in the art appreciate additional operational modes may be included as desired.

Figure 7:
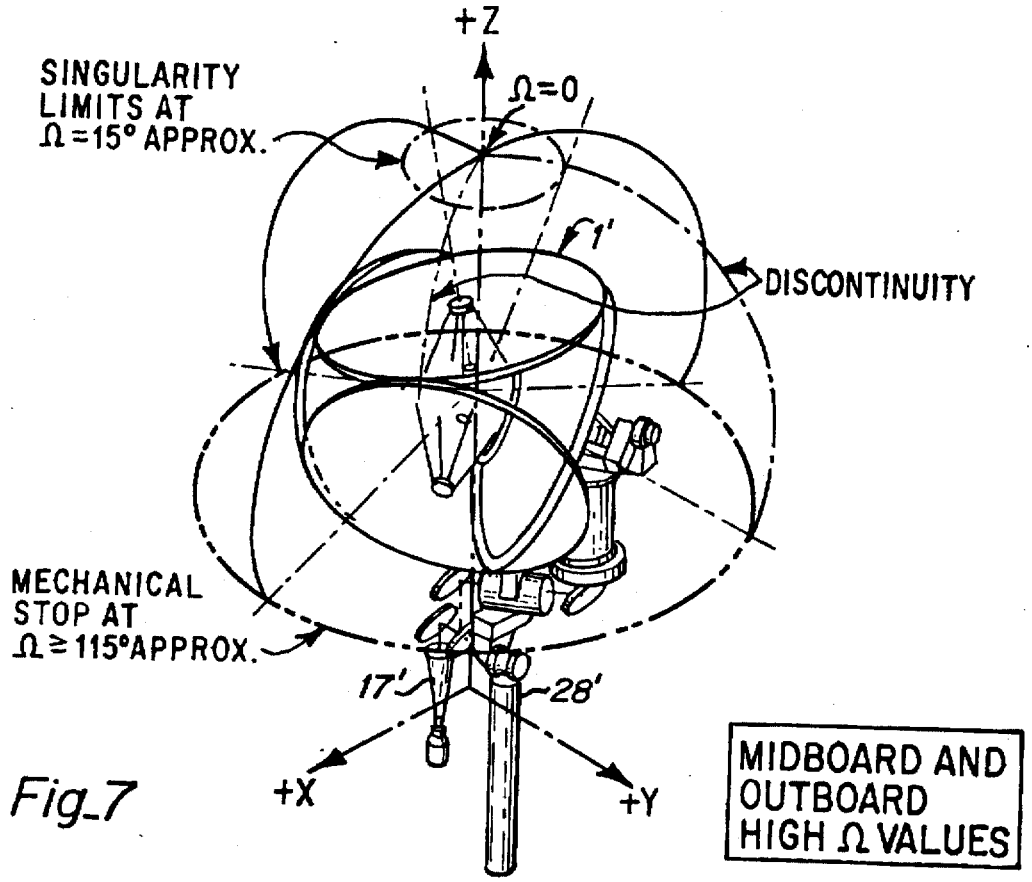
FIGS. 7 and 8 illustrate respective actuator singularities associated with respective axes of rotations of the antenna.
Figure 8:
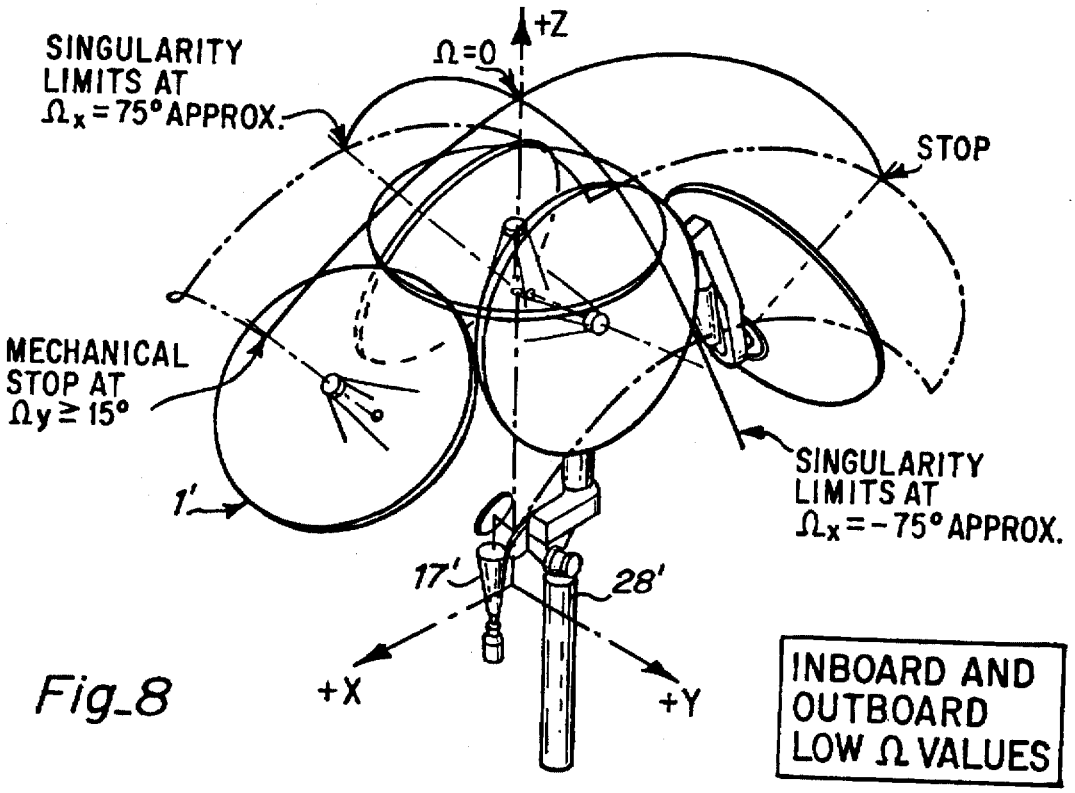

FIGS. 7 and 8 illustrate, respectively, the singularities and view angles available in a practical embodiment of the invention at high omega values in which only the outboard and midboard actuators and are used to position the antenna about the respective outboard and midboard axes, corresponding to mode 1; and at low omega values in which only the inboard and outboard actuators and are used to position the antenna about the respective inboard and outboard axes, corresponding to mode 2. As illustrated by FIG. 7, the actuators are capable of moving the antenna over a spherical angle $\Omega$ of approximately 115 degrees, limited by a mechanical stop necessitated by the beam waveguide and other mechanical elements in the system. However, within that region of movement a singularity exists between zero degrees and fifteen degrees.

As illustrated in FIG. 8, the actuators are capable of positioning the antenna 1 over $\Omega x$ of plus and minus 75 degrees before reaching a singularity and $\Omega x$ and $\Omega y$ of fifteen degrees to a mechanical stop. However no singularity appears in the region of a spherical angle of zero to fifteen degrees. It is appreciated thus that when outboard and midboard actuators 18 and 26 approach the associated singularity the system controller switches to driving inboard and outboard actuators 18 and 27 to enter the forbidden singularity region associated with the first two actuators. Such singularity is effectively rendered transparent in the system.

By design and as earlier discussed the singularities associated with mode 2 appear at positions that are substantially spherically displaced from those associated with mode 1. The computer determines the movement required by the antenna positioning motors associated with mode 2 and activates those positioning motors accordingly. Notwithstanding the program calls up the check subroutine and checks for approaches to singularity positions in this mode 2.

Effectively the rotation of the reflecting microwave mirror functions much like a rotary joint in a coaxial wave guide, permitting one portion of the waveguide to rotate relative to another portion of the waveguide, while maintaining the integrity of the microwave transmission path. The dual axis beam waveguide in the present Cassegrain antenna systems are thus said to contain two rotary joints, which are oriented for rotation ninety degrees from one another in direction, located at each end or end portion of the waveguide.

In the present wave beam system the beam waveguide in contrast contains three such rotary joints, with the axis of rotation of a first two of those joints being perpendicular to one another and the axis of rotation of the last two of those joints being perpendicular to one another. In initial position, all three rotary joints are orthogonal to one another. If looked upon as a single beam waveguide, then one of such rotary joints is located intermediate the other two. However, alternatively, one may also view the beam waveguide of the present invention as a series combination of two beam waveguides that feed into one another. First, the old type beam waveguide and, second, a second added waveguide placed in series circuit, so that the output from one feeds into the other.

In addition to singularities, FIG. 7 illustrates some stops or discontinuities as might appear to impose a limit on the antenna's field of view. A discontinuity is a mechanical stop about the midboard axis due to structural obstruction of the beam path, as noted in FIG. 7. Viewing beyond such a discontinuity is possible while in the same operational mode (discontinuities occur in mode 2). As example, by rotating the midboard axis back 180 degrees from the stop shown in FIG. 7 and rotating the outboard axis 2 $\Omega$ through $\Omega$=0, viewing is possible through the position of the illustrated discontinuity. Once the reorientation is made, the discontinuity lines are rotated by 180 degrees about the Z axis relative to the discontinuity lines shown in FIG. 7. Thus full viewing of the −Y half of the spherical field is possible without encountering discontinuities.

It is appreciated that the invention provides the antenna a greater field of view, notwithstanding the presence of a singularity within that field of view. The invention does not eliminate the singularities, but simply renders them transparent and ineffectual. Moreover, the changes in the beam waveguide structure do not result in unacceptable depolarization of circularly polarized waves.

It is noted that the foregoing embodiment illustrates the invention as part of a Cassegrain antenna, which is a particular species of dual reflector type antennas. As those skilled in the art appreciate the foregoing invention is not limited to the Cassegrain antenna and is equally applicable to other types of dual reflector antennas. Further, while the curved mirrors used in the embodiment of FIG. 1 are parabolic in shape, other curved shapes known for this type of application may be substituted. And, while mirrors have been used, it is recognized that such reference encompasses equivalent kinds of electromagnetic energy focusing lenses that are operable in the combination to serve as a portion of the microwave transmission path.

While the foregoing invention is of particular advantage in airborne satellite communication links, it is apparent that the invention also functions in land based operation, even though the circumstances for so using the invention are less compelling.

It is believed that the foregoing description of the preferred embodiments of the invention is sufficient in detail to enable one skilled in the art to make and use the invention. However, it is expressly understood that the details of the elements presented for the foregoing purposes is not intended to limit the scope of the invention, in as much as equivalents to those elements and other modifications thereof, all of which come within the scope of the invention, will become apparent to those skilled in the art upon reading this specification. Thus the invention is to be broadly construed within the full scope of the appended claims.

What is claimed is:

1. An antenna system comprising:

a dual reflector antenna angularly positionable over a range of contiguous spherical angles, said antenna including a main reflector and a subreflector;

a base;

a feed horn mounted to said base;

beam waveguide means for coupling microwave energy between said feed horn and said dual reflector antenna;

said beam waveguide means, comprising:

a first beam transmission line, said first beam transmission line, comprising:

first microwave rotary joint means connecting a first end of said first beam transmission line to said main reflector for joint rotational movement of said first beam transmission line and said main reflector about a first axis and for coupling microwave energy between therebetween;

second microwave rotary joint means connected between a second end of said first beam transmission line for supporting said first beam transmission line and said first rotary joint means for joint rotational movement about a second axis, oriented perpendicular to said first axis;

a second beam transmission line, said second beam transmission line being supported by said base and further comprising:

third microwave rotary joint means connected between said second end of said first beam transmission line and a second end of said second beam transmission line for supporting said antenna, said first beam transmission line, and said first and second microwave rotary joints for joint rotary movement about a third axis, oriented perpendicular to said second axis and for propagating microwave energy between said first and second beam transmission lines; and said feed horn and said first end of said second beam transmission line being electromagnetically coupled for transmitting microwave energy therebetween.

2. The invention as defined in claim 1, wherein said third microwave rotary joint means includes a flat mirror.

3. The invention as defined in claim 2, wherein said second beam transmission line includes a first end, and, further comprising an additional flat mirror located at said first end of said second beam transmission line.

4. The invention as defined in claim 3, wherein said first rotary joint means further includes:

electrical actuator means for rotationally positioning said antenna and first rotary joint means relative to said first beam transmission line about said first axis;

wherein said second rotary joint means further includes:

second electrical actuator means for rotationally positioning said first transmission line relative to said second transmission line about said second axis; and wherein said third rotary joint means further includes:

third electrical actuator means for rotationally positioning said first beam transmission line relative to said base about said third axis; and, further comprising:

controller means for controlling activation of each of said first, second and third actuator means; said controller means including first mode of operation for energizing said first and second actuator means without any energization of said third actuator means and a second mode of operation for energizing said second and third actuator means without any energization of said first actuator means; and means for switching between said first mode of operation and said second mode of operation.

5. The invention as defined in claim 1, wherein said first rotary joint means further includes:

electrical actuator means for rotationally positioning said antenna and first rotary joint means relative to said first beam transmission line about said first axis;

wherein said second rotary joint means further includes:

second electrical actuator means for rotationally positioning said first transmission line relative to said second transmission line about said second axis; and wherein said third rotary joint means further includes:

third electrical actuator means for rotationally positioning said first beam transmission line relative to said base about said third axis.

6. The invention as defined in claim 5, further comprising:

controller means for controlling activation of each of said first, second and third actuator means, said controller means including first mode of operation for energizing said first and second actuator means without any energization of said third actuator means and second mode of operation for energizing said first and third actuator means without any energization of said second actuator means; and means for switching between said first mode of operation and said second mode of operation.

7. An antenna system of a beam waveguide type comprising:

a dual reflector antenna, said antenna having a main reflector and a subreflector;

horn means for transmitting and receiving electromagnetic waves, said horn means being supported in a stationary position relative to said dual reflector antenna; and beam waveguide means for bi-directional propagation of electromagnetic waves between said horn means and said dual reflector antenna, said beam waveguide means further comprising;

first beam waveguide means, said first beam waveguide means further comprising:

first, second, third and fourth mirrors, with two of said mirrors being flat and two of said mirrors being curved;

said four mirrors defining a path for guiding electromagnetic waves;

said first mirror defining a first end to said path, and said second mirror defining a second end to said path for permitting electromagnetic waves to propagate bi-directionally along said path;

said curved mirrors and said flat mirrors being interleaved in said path to position one of said curved mirrors between said two flat mirrors along said path;

said four mirrors being in fixed spacial relationship relative to one another;

said first mirror and said dual reflector antenna being mounted for joint rotation about a first axis, whereby said first mirror and antenna are jointly positionable to different rotational positions about said first axis and said spacial relationship between said mirrors remains unchanged irrespective of any rotation of said first mirror;

said first mirror being focused upon said subreflector of said dual reflector antenna for bi-directionally propagating electromagnetic waves between said subreflector and said path irrespective of rotational position of said first mirror;

said first beam waveguide means being mounted for rotational movement about a second axis, orthogonal to said first axis, whereby said beam path and said dual reflector antenna are jointly positionable to different rotational positions about said second axis;

second beam waveguide means, said second beam waveguide means defining a second path for propagating electromagnetic waves and further comprising:

a fifth mirror, said fifth mirror being flat and further comprising one end of said second path;

said fifth mirror being spaced from and in fixed spacial position to said second end of said path to define a third path to permit bi-directional coupling of electromagnetic energy between said second path and said path, whereby said spacial relationship between said fifth mirror and said path remains unchanged irrespective of any rotation of said path about said second axis; and said fifth mirror being positionable to different rotational positions about a third axis with said third axis being oriented orthogonal to said second axis, whereby said beam path, said dual reflector antenna and said fifth mirror are jointly positionable to different rotational positions about said third axis and whereby said spacial relationship between said fifth mirror and said path remains unchanged irrespective of any rotation of said fifth mirror;

said horn means being coupled to a second end of said second beam waveguide means for bi-directional propagation of electromagnetic waves therebetween.

8. The invention as defined in claim 7, wherein said second beam waveguide further comprises:

a sixth mirror, said sixth mirror being flat and further comprising a second end to said second path;

said sixth mirror being mounted in fixed spacial position relative to said fifth mirror and to said horn means for bi-directional coupling of electromagnetic waves between said horn means and said second path, whereby said spacial relationship between said sixth mirror and said fifth mirror remains unchanged irrespective of any rotation of said fifth mirror.

9. The invention as defined in claim 8, wherein said first mirror comprises one of said two flat mirrors; and wherein said second mirror comprises one of said two curved mirrors.

10. The invention as defined in claim 9 wherein said two curved mirrors comprise a parabolic curve.

11. The invention as defined in claim 8, further comprising:

first electrical actuator means for jointly rotationally positioning said first mirror and dual reflector antenna about said first axis;

second electrical actuator means for rotationally positioning said first waveguide means about said second axis jointly with said dual reflector antenna; and third electrical actuator means for rotationally positioning said fifth mirror about said third axis jointly with said first waveguide means and said dual reflector antenna.

12. The invention as defined in claim 8, wherein said first mirror comprises one of said two curved mirrors; and wherein said second mirror comprises on of said two flat mirrors.

13. The invention as defined in claim 8, wherein each of said fifth and sixth flat mirrors further comprise an ellipse in geometry.

14. The invention as defined in claim 7, further comprising:

first electrical actuator means for jointly rotationally positioning said first mirror and dual reflector antenna about said first axis;

second electrical actuator means for rotationally positioning said first waveguide means about said second axis jointly with said dual reflector antenna; and third electrical actuator means for rotationally positioning said fifth mirror about said third axis jointly with said first waveguide means and said dual reflector antenna.

15. The invention as defined in claim 14, further comprising:

controller means for controlling operation of each of said first, second and third electrical actuator means;

said controller means, including program means, said memory means including means defining the hemispherical coordinates of a first set of forbidden rotational positions about said first and second axes and defining the hemispherical coordinates of a second set of forbidden rotational positions about said first and third axes;

said program means defining a first mode of operation in which only said first and second actuator means may be energized, but not said third actuator means and a second mode of operation in which only said first and third actuator means may be energized, but not said second actuator means;

said program means including selection means for selecting one of said first and second modes of operation;

means for periodically checking proximity of rotational positions to said set of forbidden rotational positions associated with said selected mode of operation set by said selection means; and means responsive to detection of said proximity falling below a predetermined level to cause said selection means to select the other of said operational modes.

16. The invention as defined in claim 7, wherein said dual reflector antenna comprises a Cassegrain antenna.

17. An antenna system of a beam waveguide type comprising:

a Cassegrain dual reflector antenna, said antenna having a main reflector and a subreflector;

horn means for radiating electromagnetic waves; and beam waveguide means for propagating electromagnetic waves from said horn means to said Cassegrain dual reflector antenna;

said beam waveguide means further comprising:

first and second planar mirrors;

first and second parabolic mirrors;

said plane and parabolic mirrors defining a path for guiding electromagnetic waves to said dual reflector antenna;

said first planar mirror defining an exit to said path for guiding electromagnetic waves to said dual reflector antenna and said first parabolic mirror defining an entrance to said path for permitting electromagnetic waves to enter for propagation along said path to said dual reflector antenna;

said first planar mirror and said first parabolic mirror being positioned along a first common axis to place said path exit and entrance coaxial of said first common axis;

first support means for holding said first and second planar and parabolic mirrors in a fixed spacial relationship relative to one another;

second support means for supporting said first planar mirror and said dual reflector antenna in fixed spacial relationship;

first rotary joint means for mounting said second support means to said first support means for rotation on said first support means about a first axis, whereby said spacial relationship between said first and second planar and parabolic mirrors remains unchanged irrespective of any rotation of said first planar mirror;

a third planar mirror, said third planar mirror for guiding electromagnetic waves incident thereon along said first common axis to said path entrance;

third support means for supporting said third planar mirror in fixed spacial relationship with said first parabolic mirror;

second rotary joint means for mounting said first support means to said third support means for rotation on said third support means about a second axis, whereby said spacial relationship between said third planar mirror and said first parabolic mirror remains unchanged irrespective of any rotation of said first parabolic mirror;

a fourth planar mirror, said fourth planar mirror for guiding electromagnetic waves from said horn to third planar mirror;

fourth support means for supporting said fourth planar mirror and said horn in fixed spacial relationship with said third planar mirror;

third rotary joint means for mounting said third support means to said fourth support means for rotation on said fourth support means about a third axis, whereby said spacial relationship between said third planar mirror and said fourth planar mirror remains unchanged irrespective of any rotation of said third planar mirror relative to said horn;

said first and second axes being oriented perpendicular to one another and said second and third axes being oriented perpendicular to one another; and said fourth planar mirror being mounted in fixed relationship to said horn means and to said fourth support means, whereby said Cassegrain antenna is rotatable in any of three mutually orthogonal directions with respect to said horn.

18. The invention as defined in claim 17, further comprising:

first electrical actuator means mounted to said first support means for controlling rotational movement of said first rotary joint;

second electrical actuator means mounted to said third support means for controlling rotational movement of said second rotary joint; and third electrical actuator means mounted to said fourth support means for controlling rotational movement of said third rotary joint.

* * * * *